US005638924A

United States Patent [19]

Kremer

[11] Patent Number: 5,638,924

[45] Date of Patent: Jun. 17, 1997

[54] DISK BRAKE FOR TEXTILE YARNS

[75] Inventor: Hubert Kremer, Grefrath, Germany

[73] Assignee: Hacoba Textilmaschinen, Germany

[21] Appl. No.: 288,297

[22] Filed: Aug. 10, 1994

[30] Foreign Application Priority Data

Aug. 11, 1993 [DE] Germany ..... 9311971 U

[51] Int. Cl.[6] ..... B65H 59/20

[52] U.S. Cl. ..... 188/65.1; 66/146; 242/150 R

[58] Field of Search ..... 188/65.1–65.5, 188/83–84, 382, 264 A; 66/146; 15/303, 306.1, 309.1, 316.1; 244/150 R, 150 M, 147 A, 419.4, 47

[56] References Cited

U.S. PATENT DOCUMENTS

| | | | |
|---|---|---|---|
| 1,309,790 | 7/1919 | Walsh | 15/309.1 X |
| 1,375,663 | 4/1921 | Ainsworth | 15/309.1 X |
| 4,157,722 | 6/1979 | Tojo et al. | 242/150 R X |
| 5,318,155 | 6/1994 | Alder et al. | 188/65.1 |

*Primary Examiner*—Robert J. Oberleitner
*Assistant Examiner*—Peter M. Poon
*Attorney, Agent, or Firm*—Charles A. Wilkinson

[57] ABSTRACT

A disk brake for placing tension on textile yarns is provided with an air-cleaning system for blowing lint and fiber dust particularly from the underside of the disks to prevent a buildup which may interfere with operation of the brake disks and prevent proper clamping action between the disks.

19 Claims, 2 Drawing Sheets

DISK BRAKE FOR TEXTILE YARNS

Figure 1:
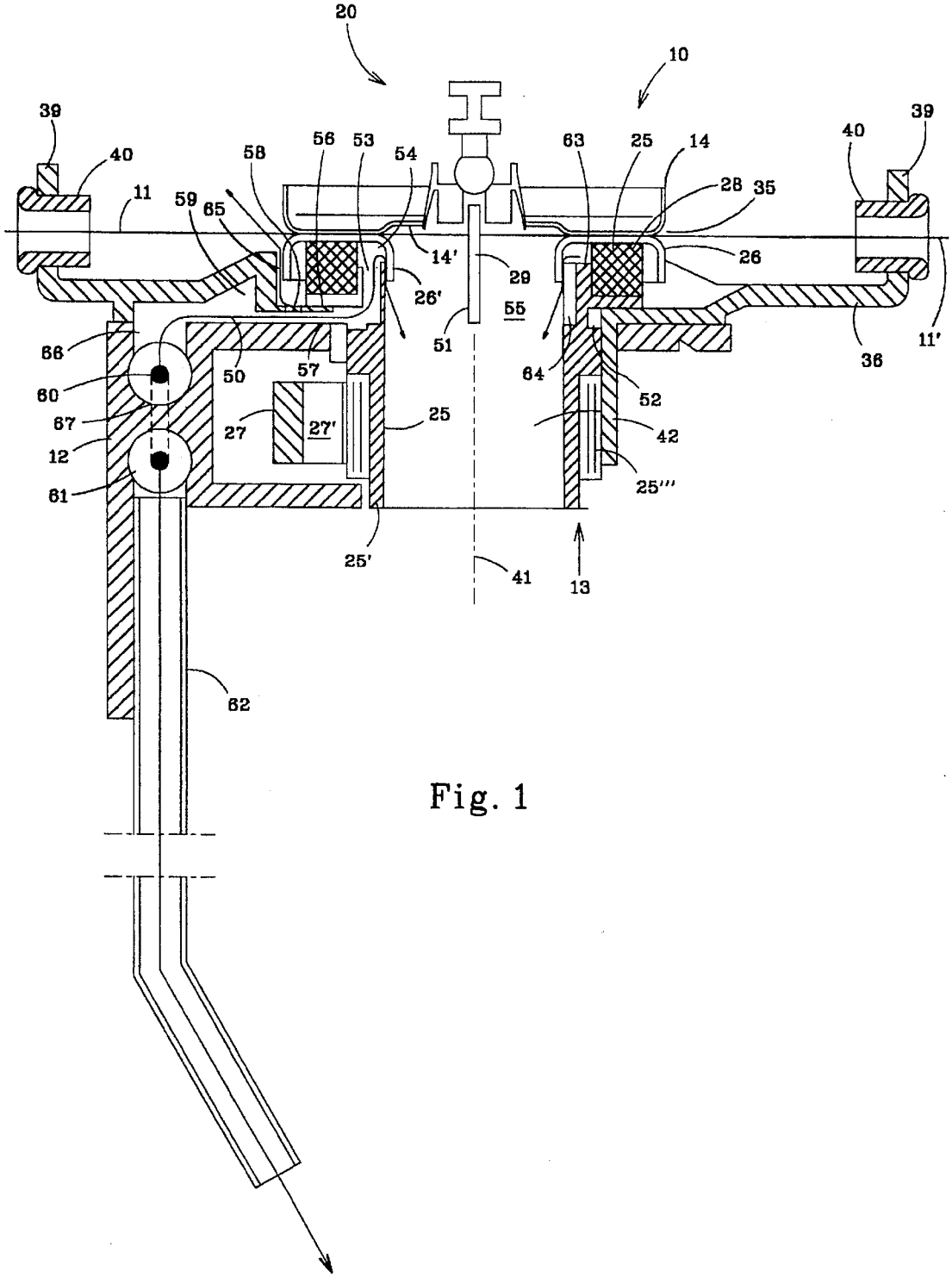

The invention relates to a disk brake for textile yarns having a vertical, hollow disk supporting two braking disks and resting in a pivoting position on a bearing plate attached to a brake anchor plate surrounding the disk axis above the brake anchor plate and below the upper braking plate.

A disk brake having the above-described characteristics is known from EP 0,529,429 A1. The known disk brake pivots in an oscillating fashion so that one or both braking disks of the disk brake move back and forth. This is intended to prevent lint and other matter from collecting in the area of the braking disks, as is the case with stationary or rotating braking disks. Any accumulation of fiber dust or lint would impair the brake force. The disk brake having the characteristics outlined above achieves this objective in a number of ways. When fiber dust collects in the hollow space of the disk axis, it can cause the upper disk and the weighting element above it to rise, disrupting the adjustable tensile strength of the yarn. A textile yarn stopped by the disk brake then no longer has the necessary tension and, consequently, is wound too loosely around the winding frame which draws a number of textile yarns from a bobbin creel. This interferes with the lap build-up and potentially with the process of unwinding, if, for example, the machine is shut down.

Prior art has attempted to prevent the excessive accumulation of fiber dust by using migrating blowers. Such a migrating blower is equipped with a tube extending beyond the height of the creel. Horizontal tubes extend from said tube, each blowing air onto one disk brake. The air is blown intermittently because the migrating blower has to be moved horizontally from one vertical row of disk brakes to another. As a result, it is not possible to provide for continuous blowing of all of the disk brakes. Moreover, the length of time it takes to blow air along the length of the bobbin creel depends on the speed of the migrating blower. The latter interferes with the working process whenever a yarn has to be repaired in its vicinity or when a bobbin has to be replaced. Furthermore, the problem of cleaning the interior portions of disk brakes has not been resolved with the approach of blowing air from the outside.

The object of the invention, therefore, is to improve a disk brake having the characteristics outlined above in such a way that the accumulation of dust, in particular on the interior of the disk brake, is prevented.

This problem is resolved in that the disk support and the bearing plate have at least one air duct, which on one side is connected to a compressed air source and on the other opens into fiber dust receptacles in the area of the lower disk.

A significant feature of the invention is that the disk support and the bearing plate have an air duct, through which air can be blown onto the bottom of the lower disk. In other words, a special modification is made to the disk brake in the area of its disk axis and in the area of its bearing plate, making it possible to blow away the fiber dust below the lower disk and access those areas that would not be reached by blowing in a general direction from above or below. The process of blowing onto the disk brake in the area of the lower disk can be modified according to the construction of the disk brake. Hence, it is principally possible to keep any area of the disk brake free of lint.

A significant feature of the disk brake in particular is that it is essentially rotationally symmetrical. It is therefore advantageous to design the disk brake in such a manner that the air duct is a sealed snap ring groove along the disk support, having vertical outlets opening directly below the lower disk. Because of the snap ring groove of the air duct, air can be blown onto as many parts of the disk brake as necessary. This is achieved by positioning the outlets in selected locations as needed.

In order to control the discharge of the air blown under the lower disk and at the same time clean the hollow space of the disk support, the disk brake is designed in such a way that the air flows between the bottom of the lower disk and the hollow space of the disk support.

The disk brake can be designed in such a way that compressed air is blown from the outlets of the air duct through a porous ring flexibly supporting the lower disk. This prevents the accumulation of dust in the area of the ring and it also prevents the ring from hardening. The accumulation of dust would cause the ring to harden and further cause the lower disk to be incapable or insufficiently capable of moving aside when yarn slubs or knots pass through the disk brake. A hardening of the ring would lead to yarn breakage. The risk of yarn breakage can be avoided by cleaning the porous ring with compressed air.

If the disk brake is designed in such a way that radially positioned blowing outlets open into the snap ring groove surrounding the ring sandwiched between the lower disk and bearing plate and supporting the lower disk, then the disk brake will be cleaned not only on the inside of the disk support, but also in the area between the disk axis and the bearing plate surrounding it. The expense of including additional blowing outlets is insignificant.

In order to supply compressed air around the snap ring groove from the outside, the disk brake is designed in such a way that the air duct in the bearing place has radially positioned air inlet slits leading air to the snap ring groove. By adjusting the number and distribution of air inlet slits, compressed air can also be supplied to a snap ring groove having small cross-sectional dimensions without resulting in significant throttling losses.

In order to intensify the force of the air blown into the space between the disk brake and the bearing plate surrounding it, the disk brake is designed in such a way that the air inlet slits are connected to air holes, which blow air around the outside of the ring supporting the lower disk and sandwiched between it and the bearing plate.

Another potential means of cleaning the inside of the disk brake is given when the air duct in the bearing plate has a ring channel for distributing compressed air around the lower disk. Air can be blown out of such a ring channel and directly into the space between the disk support and the bearing plate surrounding it without necessitating the construction of a snap ring groove in the disk support. However, having a ring channel in the bearing plate is also advantageous with respect to supplying compressed air to the disk support.

In order to assure the supply of compressed air to the snap ring groove, the disk brake is designed in such a way that the ring channel in the bearing plate is connected to the snap ring groove via the air inlet slits. The resulting construction is simple.

The disk brake can be designed in such a way that an air supply duct is positioned in a horizontal brake anchor plate supporting other disk brakes and having vertical connecting bores leading to the ring channels of the disk brake bearing plates. Thus, compressed air is supplied to a number of brakes having a shared air supply duct. The arrangement of an air supply duct in the brake anchor plate permits a simple construction of the entire air supply system; the brake anchor plate can easily admit air through compressed air supply ducts in the event that it does not already have a hollow chamber for air supply.

A further development of the disk brake is given in that the first air supply duct is connected to another air supply duct running parallel to it and connected to it and/or having elastic tubes, which blow onto the disk brake situated on the next lower bobbin level. The second, parallel air supply duct improves the supply of compressed air to the disk brake and provides a regulated, constant source of compressed air or makes it possible to blow air onto another disk brake from all sides and in particular from the top.

To permit a practical design of a central air supply source, the disk brake is designed in such a way that air is fed into the air supply duct from one end and/or from the area adjoining a bobbin creel section.

The invention is illustrated by way of example.

Figure 2:
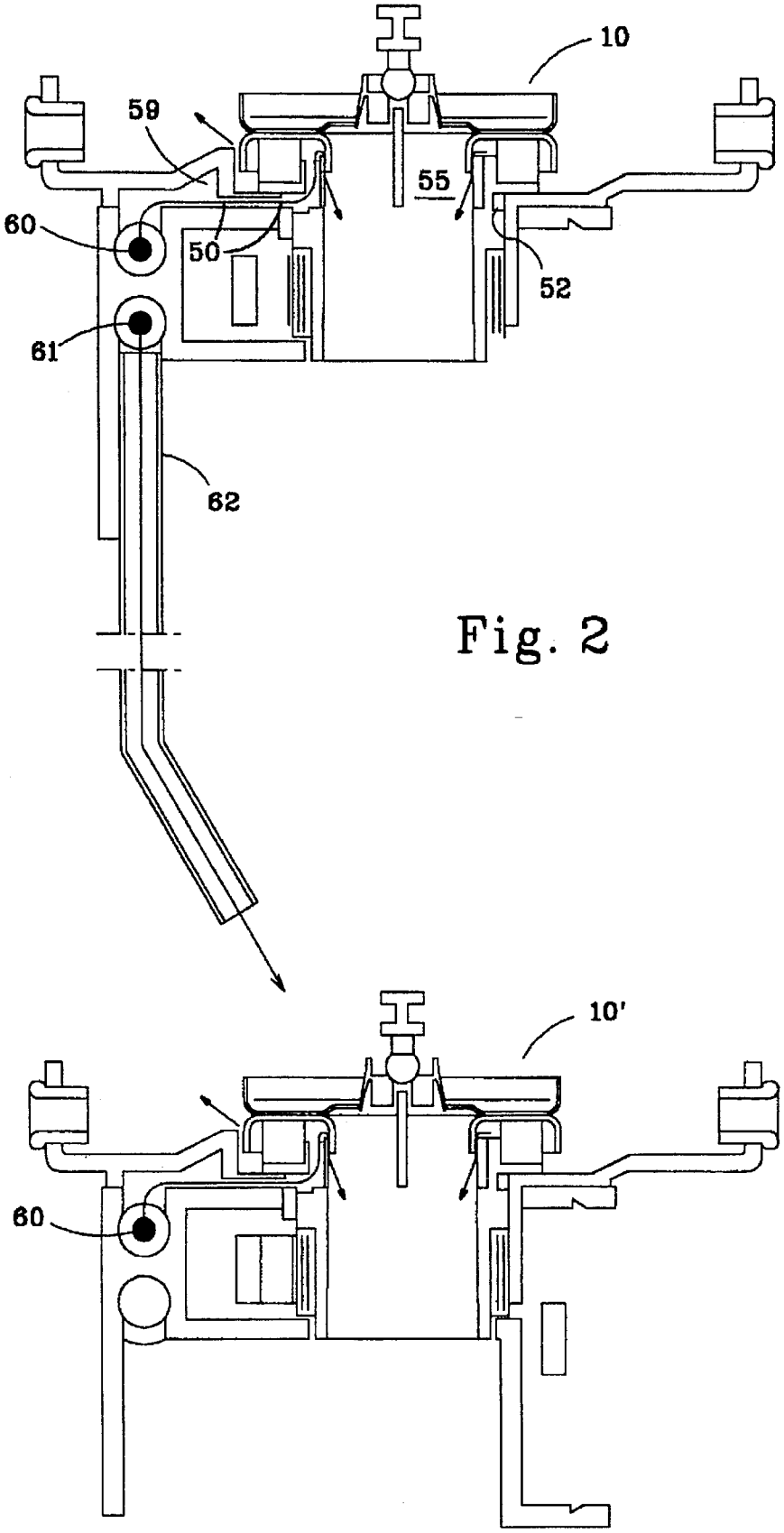

FIG. 1 is a cross section of a disk brake having the interior cleaning capabilities characteristic of the invention, and FIG. 2 illustrates two disks positioned on top of each other in a vertical row of bobbin creels.

Yarn 11, shown in FIG. 1, is pulled from the bobbin of a bobbin creel, not shown, in the direction of arrow 11' by a winding frame such as a sectional warping machine or a warping machine. Yarn 11 runs through disk brake 10, which provides it with the tensile strength necessary for winding. Disk brake 10 has an upper disk 14, which rests on a lower disk 26. Together with the flattened surfaces indicated, the two disks form disk gap 35, through which yarn 11 is pulled into and through disk brake 10.

Disks 14 and 26 are saucer-shaped sheet metal parts, the outer rims of which point upward and downward respectively and parallel to a central axis 41. In addition, disks 14 and 26 form interior recesses 14' and 26' where the inside rims run parallel to the outside rims; disks 14 and 26 are actually ring-shaped.

A disk brake 10 is arranged with its disks 14 and 26 on a horizontally extended brake anchor plate 12 having an F-shaped cross section as shown in FIG. 1. Above said brake anchor plate 12, or directly on top of it, is a bearing plate 36 holding the yarn eyelets 40 with the U-bends 39, which eyelets are positioned on a level with disk gap 35. This positioning establishes the course of yarn 11 through yarn tension device 10.

Bearing plate 36 has a disk support 13 to support disks 14 and 26. The disks are supported on a resilient ring such as a foam rubber ring. This makes it possible for lower disk 26 to move down to evade knots in yarn 11 as it passes through. At the same time, this ring 28 is sufficiently rigid to withstand the compacting force applied to the upper disk 14 by a compacting device.

The resilient ring 28, in turn, is supported directly or indirectly by disk support 13. To this end, disk support 13 is attached to bearing plate 36, which can support ring 28. The foregoing would be suitable for a disk brake without a mechanism for cleaning yarn. Ring 28, however, is indirectly supported by bearing journal 25, with which lower disk 26 is to be rotated over or atop ring 28. Bearing journal 25 has a shaft end 25', which crosses through brake anchor plate 12, but bearing journal 25 is not supported directly by brake anchor plate 12. Instead, it is supported by or through bearing recess 24, which is formed by projecting ring 42 and bearing plate 36. Said bearing recess 24 extends radially about bearing journal 25 adjacent brake anchor plate 12 and bearing plate 36 in such a way that bearing journal 25 can circumferentially support ring 28, having an exterior dimension 25", from the neighboring bearing plate 36 relative to which it rotates.

Rod 27, traversing parallel to the bearing, actuates bearing journal 25 by moving back and forth in a direction vertical to the projection shown. The extent of the movement is such that lower disk 26 turns more than 360°. This ensures that most of the loose fiber is rubbed off the yarn without being able to accumulate in the area of the disk. In addition, it prevents the two disks from catching. Traversing rod 27 engages with tooth wheel 25'" on end 25' of the bearing journal.

The actuation of bearing journal 25 impacts only lower disk 26 through ring 28. Spring 29, consisting of a piece of wire, makes it possible for the upper disk to move back and forth in an equal measure. One end of the spring is mounted into the hollow formed by bearing journal 25. The interior diameter is large enough to permit the inner rim of the disk protruding in the direction of brake anchor plate 12 to engage with bearing journal 25. The other end of the wire spring is mounted into upper disk 14. We refer to a relevant description of this feature in EP 0,529,429 A1.

To produce brake force, upper disk 14 is pressed onto lower disk 26. Compacting device 20 is also described in EP 0,529,429 A1 and is referred to here.

The disk brakes 10 shown in FIGS. 1 and 2 each exhibit an air duct 50, with which air can be blown onto one or more fiber dust receptacles 51 in the area of lower disk 26. Air duct 50 is indicated in FIGS. 1 and 2 with continuous, thin lines depicting the course of air duct 50 below lower disk 26. The arrows on the thin lines represent the openings of air duct 50.

In the area of disk support 13 and bearing journal 25, air duct 50 has a snap ring groove 52 which, although not illustrated here, is sealed from bearing plate 36. Regularly positioned axial or vertical outlets radiate from snap ring groove 52 around the circumference of disk support 13 and lead directly to underside 54 of lower disk 26. From this underside 54, air flows into hollow space 55 of disk support 13. If the cross section of the passage between the interior rim of disk 26 and the top end 63 of bearing journal 25 is not large enough to accommodate the air supply, slit-shaped connecting outlets 64 can be employed. Although not shown here, such outlets would be equally distributed around the interior circumference of bearing journal 25. Both the underside 54 of disk 26 as well as hollow space 55 can be cleaned by using the compressed air discharged in this area.

While not depicted here, compressed air flows from underside 54 of lower disk 26 through the porous ring 28 and thus prohibits it from hardening as a result of accumulated dust. The dust blown out of ring 28 is conveyed to a space 65 between bearing journal 25 and its ring 28 and between said bearing journal and bearing plate 36. From here, any dust is blown upwards and out as shown, whereby the blowing outlets 56 connecting snap ring groove 52 with space 62 are optional.

To keep the interior parts of brake 10 clean, the air flows out of air supply duct 60 through connecting bore 66 and onto ring channel 59 in bearing plate 36. From there, the air flows through the air inlet slit or slits 57 into ring groove 52 of disk axis 13. Ring groove 52 has one or more vertical openings 53. Air flows out of the openings against underside 54 of lower disk 26 and from there is redirected to flow into the hollow space 55 in disk support 13 on one side and through the porous ring 28 in space 65 on the other.

In order to supply compressed air to ring groove 52, bearing plate 36 has the radial air inlet slits 57. Said air inlet slits, in turn, are supplied by ring channel 59 in bearing plate 36. The air inlet slits 57 are equally distributed around the circumference of bearing plate 36 and can be connected with blowing outlets 58, which blow out of ring channel 59 the short distance into space 65 between bearing plate 36 and ring 28 to ensure the effective removal of any fiber dust.

Ring channel 59 in bearing plate 36 is formed by a recess sealed from anchor plate 12 and situated above bore 66, which is connected with air supply duct 60. Air supply duct 60 runs parallel inside of brake anchor plate 12 and enters through an opening not shown here.

Another air supply duct, 61, is shown parallel to air supply duct 60, which can be connected to air supply duct 60 via a bore 67. It then becomes possible to connect both air supply ducts 60 and 61 to the compressed air supply of air duct 50, creating greater blowing force. But air supply duct 61 may also be used to admit a tube 62 which, as shown in FIG. 2, blows onto disk brake 10'. In this case, air supply ducts 60 and 61 are not connected, as shown.

The air supply to air supply ducts 60 and 61 enters at one or both of their ends. However, it is also possible to supply air to individual sections, in which case each section of a bobbin creel is supplied separately, which is advantageous if, for instance, bobbins are replaced in sections along the bobbin creel. Tube 62, shown in FIG. 2, can be made of elastic material and hence would not interfere with work along the bobbin sections when bobbins are replaced. If the section-by-section approach is used, the air ducts 60 and 61 of one section must of course be separated from the air ducts 60 and 61 of an adjoining section where the two sections meet. The supply of compressed air to the entire bobbin creel is determined according to individual conditions. The bobbin creel can be supplied with continuous and/or intermittent blasts of compressed air. The air supply setting may be adjusted via electrical devices.

The foregoing description applies accordingly to double disk brakes.

I claim:

1. A disk brake for textile yarns having a vertically oriented hollow disk support which supports two braking disks positioned on a pivoting bearing plate attached to a brake anchor plate surrounding the disk support situated adjacent the brake anchor plate and below an upper braking disk characterized in that the disk support and bearing plate incorporate at least one air duct which on one side leads to a compressed air source and on the other circulates air across the lower surface of the lower of the two braking disks and into a hollow space radially within the center of said lower braking disk.

2. A disk brake according to claim 1, characterized in that the air duct is a sealed snap ring groove associated with the disk support having outlets which open directly below the lower disk.

3. A disk brake according to claim 2, characterized in that compressed air is blown from the outlets of the air duct through a porous ring supported upon the hollow rotatable disk support and flexibly supporting the lower disk.

4. A disk brake according to claim 2, characterized in that radially positioned blowing outlets open into the snap ring groove surrounding a porous ring sandwiched between the lower disk and the bearing plate supporting the lower disk.

5. A disk brake according to claim 2, characterized in that the air duct in the bearing plate has radially positioned air inlet slits positioned to supply air to the snap ring groove.

6. A disk brake according to claim 5, characterized in that the air inlet slits are connected to air holes opening around the ring supporting the lower disk and sandwiched between the lower disk and the bearing plate.

7. A disk brake according to claim 1, characterized in that the air duct includes a ring channel for distributing compressed air blown around the lower disk.

8. A disk brake according to claim 7, characterized in that the ring channel and the bearing plate are connected to a snap ring groove in the disk support via air inlet slits.

9. A disk brake according to claim 1, characterized in that an air supply duct is situated in a horizontal brake anchor plate supporting at least one disk brake and having vertical connecting bores leading to ring channels in at least one disk brake bearing plate.

10. A disk brake according to claim 9, characterized in that a second air supply duct runs parallel to a first air supply duct and is connected to the air supply duct of the first air supply duct and has elastic tubes blowing on a disk brake situated on a lower bobbin level.

11. A disk brake according to claim 9 or 10, characterized in that air is fed into the first and second air supply ducts from one end from an area adjoining a bobbin creel section.

12. A disk brake for textile yarns comprising:

(a) two adjacent braking disks at least the lower of which has a hollow center portion, (b) a resilient support under the lower braking disk allowing said lower disk to move downwardly to pass enlargements in yarn passing between the braking disks, (c) a rotatable support for the resilient support under the lower disk, (d) an air passage within the rotatable support connected at one end to an air supply on the outer perimeter of the lower disk and at the other end to the hollow center of the lower brake disk whereby flowing air can be passed across the lower surface of the lower brake disk to prevent accumulation of solid material in the area below the lower disk including the resilient support for the said lower disk.

13. A disk brake in accordance with claim 12 wherein the air passage is extended from the outer perimeter of the lower brake disk under the disk and into the hollow center portion of the lower disk.

14. A disk brake in accordance with claim 13 wherein the resilient support is a flexible porous ring and the passage of air past the ring prevents clogging of the pores of such ring.

15. A disk brake in accordance with claim 14 wherein there are dust accumulation openings in areas adjacent the flexible porous ring.

16. A disk brake in accordance with claim 15 wherein there is a circumferential air passage about the outer perimeter of the lower brake disk connected to the air supply.

17. A disk brake for textile yarns having a vertically oriented hollow disk support which supports two braking disks positioned on a pivoting bearing plate attached to a brake anchor plate surrounding the rotatable disk support situated adjacent the brake anchor plate and below an upper braking disk characterized in that the disk support and bearing plate incorporate at least one air duct which on one side leads to a compressed air source and on the other into fiber dust receptacles in the area of the lower disk and in which the air duct takes the form of a sealed snap ring groove associated with the disk support having outlets which open directly below the lower disk.

18. A disk brake according to claim 17 characterized in that air flows between the underside of the lower disk and a central hollow space of the disk support.

19. A disk brake according to claim 18 characterized in that compressed air is blown from the outlets of the air duct through a porous ring flexibly supporting the lower disk.

* * * * *